US006066214A

United States Patent [19]

Comfort

[11] Patent Number: 6,066,214

[45] Date of Patent: May 23, 2000

[54] SOLID ROCKET PROPELLANT

[75] Inventor: Theodore F. Comfort, Cumberland, Md.

[73] Assignee: Alliant Techsystems Inc., Hopkins, Minn.

[21] Appl. No.: 09/183,750

[22] Filed: Oct. 30, 1998

[51] Int. Cl.[7] ..... C06B 45/10

[52] U.S. Cl. ..... 149/19.4; 149/19.6; 149/19.1; 149/76

[58] Field of Search ..... 149/19.1, 19.4, 149/19.6, 76

[56] References Cited

U.S. PATENT DOCUMENTS

| | | | |
|---|---|---|---|
| 3,622,408 | 11/1971 | Lyerly | 149/108.8 |
| 4,094,028 | 6/1978 | Fujiyama et al. | 441/31 |
| 5,348,596 | 9/1994 | Goleniewski et al. . | |
| 5,372,070 | 12/1994 | Neidert et al. . | |
| 5,467,715 | 11/1995 | Taylor et al. . | |
| 5,639,987 | 6/1997 | Berteleau et al. . | |
| 5,654,520 | 8/1997 | Boberg et al. | 102/205 |
| 5,783,769 | 7/1998 | Goleniewski et al. . | |

*Primary Examiner*—Edward A. Miller
*Attorney, Agent, or Firm*—Nikolai, Merseraeu & Dietz, P.A.

[57] ABSTRACT

A solid propellant composition includes an oxidizer, a fuel and a binder, the oxidizer containing a significant amount of bismuth oxide ($Bi_2O_3$)

16 Claims, 2 Drawing Sheets

SOLID ROCKET PROPELLANT

BACKGROUND OF THE INVENTION

I. Field of the Invention

The present invention relates generally to improvements in the performance of solid composite propellant compositions including those useful for a variety of rocket motors containing one or more plasticizers and binders, a fuel, and one or more oxidizers. More particularly, the invention is directed to improvements modifying the oxidizer fraction of the composition which significantly enhances the performance of rocket motors using the propellant. The invention is particularly applicable to propellent compositions of a class using metal fuel and containing relatively large amounts of ammonium perchlorate or ammonium nitrate in the oxidizer fraction. A significant amount of the ammonium compounds are removed and replaced by including a relatively large amount of bismuth oxide ($Bi_2O_3$) as an oxidant in the oxidizer fraction.

II. Related Art

Solid rocket motor propellants have become accepted and widely used for the most part because they advantageously are relatively easy to manufacture and exhibit excellent performance characteristics. In addition, rocket motors utilizing solid fuel are generally a great deal less complex than those employing liquid fuels. The solid propellant is normally in the form of a propellant grain placed within the interior of the rocket motor and burned to produce quantities of hot gases which, in turn, exit through the throat and nozzle of the rocket motor at high velocity to provide thrust which propels the rocket in the opposite direction. An important consideration with regard to solid fuels is the amount of thrust available for a given volume of the propellant grain. Of course, the thrust is related to the mass and velocity of the material exiting the rocket motor. Increases in this factor, i.e., mass and/or velocity, of course, are desirable in order to increase total efficiency of the rocket motor itself. Thus, achieving an increase in the total thrust of a rocket motor, without the necessity of increasing its size, an impulse-and-density product gain, is one important sought-after fuel improvement goal.

It is known to use bismuth oxide ($Bi_2O_3$) as a constituent in certain solid propellant compositions. Thus, as disclosed by Neidert et al. in U.S. Pat. No. 5,372,070, $Bi_2O_3$ has been used as a relatively non-toxic, non-hazardous burn rate modifier to replace lead or other toxic materials in nitrate ester/ammonium nitrate propellants, particularly of the cross-linked double-base (XLDB) type. Thus, it has been found that the addition of relatively small amounts as 0.5 percent to about 8.0 percent, but preferably from about 1.0 to about 3.0 percent bismuth trioxide has resulted in a more controllable and usable burn rate for propellant compositions of the XLDB class.

With respect to the present invention, XLDB propellants are of a relatively more hazardous class (mass-detonable) and the bismuth trioxide is added for a different purpose. That reference does not disclose the use of $Bi_2O_3$ in propellents of the class of the present invention (non-mass-detonable) nor the possibility of using $Bi_2O_3$ to replace significant amounts of other oxidizing materials in such compositions, including the fact that a gain in total thrust might be achieved by doing so.

The use of certain polyether-type polymer binders has also been disclosed in relation to solid composite propellant compositions of the class of the present invention by Goleniewski et al in U.S. Pat. No. 5,349,596. Those binders include non-crystalline polyethers used to improve safety in combination with inert plasticizers, i.e., plasticizers which do not have a positive heat of explosion (HEX).

Another patent to Goleniewski et al (U.S. Pat. No. 5,783,769) reveals solid composite propellant compositions that employ non-crystalline polyether binders in combination with energetic plasticizers (positive HEX).

There remains a need and quest in the art to produce more efficient propellant performance in solid propellant compositions for rocket motors. Accordingly, it is a primary object of the present invention to provide solid composite propellant compositions having enhanced performance which include an oxidizer fraction having a significant amount of bismuth trioxide ($Bi_2O_3$).

Other objects and advantages will become apparent to those skilled in the art upon familiarization with the specification and claims herein.

SUMMARY OF THE INVENTION

By means of the present invention, significantly higher rocket motor performance has been realized in certain metal fueled propellent formulations which traditionally contain oxidizers that include large amounts of ammonium perchlorate and/or ammonium nitrate. Hence, enhanced performance has been realized by the discovery that when bismuth oxide ($Bi_2O_3$) is substituted for a significant fraction of lighter conventional oxidizer materials in the motor propellent grain, the total motor output can be boosted. This boosted output may amount to 10% or more.

In this regard, while the theoretical impulse is lowered in the new compositions, the density or mass of the grain is increased enough to more than offset the lower impulse and this gives the propellents of the invention the theoretical impulse-density product gain of about 10%. Because the bismuth oxide ($Bi_2O_3$) is more dense ($\rho$=8.9 g/cc) than ammonium perchlorate ($\rho$=1.95 g/cc) or ammonium nitrate ($\rho$=1.725 g/cc) the mass of the grain is increased significantly. The solids loading of the propellant grain has also been increased from about 81 to 85% without loss in volume fraction of the binder or in propellent processability. It is further contemplated, based on the present invention, that the relatively dense oxygen source $Bi_2O_3$ could also replace other lighter oxygen sources in other formulations.

While the propellent compositions of the present invention can contain from 10% to about 40% or more, the preferred range includes about 20% or more of the bismuth oxide. Propellants of a class particularly benefited include those using metal fuels selected from aluminum, magnesium and zirconium and mixtures thereof which are combined with the oxidizers and certain other constituents in an amount of hydroxy terminated polyether polymer binder and, typically, a larger amount of an energetic plasticizer selected from n-butyl-2-nitratoethyl nitramine (BuNENA), trimethloethane, trinitrate (TMETN), triethyleneglycol dinitrate (TEGDN), butanetriol trinitrate (BTTN), and mixtures thereof or other similar materials known to those skilled in the art.

The hydroxy-terminated polyether (HTPE) binders are generally crystalline or non-crystalline polyethers having a number average molecular weight from about 1000–9000. These include various co-polymers of ethylene oxide and tetrahydrofuran (THF). One preferred material is derived from THF and polyethelene glycol (PEG) and is known as TPEG. This and other such polyethers are available from E.I. du Pont de Nemours, Inc. of Welmington, Del., under a variety of trade names and others such as Alliant Techsystems—ABL of Rocket Center, W.Va.

Table I depicts a composition chart showing approximate ranges of the various materials suitable for the propellant compositions of the present invention.

TABLE I

| INGREDIENT | ALTERNATIVE INGREDIENTS | RANGE, % | FUNCTION |
|---|---|---|---|
| TPEG | Hydroxyl terminated polyethers having a number average molecular weight of 1000 to 9000 | 3–12 | Binder |
| BuNENA | TMETN, TEGDN, BTTN and Mixtures | 5–15 | Plasticizer |
| $Bi_2O_3$ | — | 10–40 | Oxidizer |
| Ammonium Perchlorate | — | 25–60 | Oxidizer |
| Ammonium Nitrate | — | 0–10 | Oxidizer |
| Aluminum | Magnesium, Zirconium and combinations | 15–25 | Fuel |
| Isocyanates(Poly Functional) | Such as IPDI[(a)], HDI[(b)], DDI[(c)], N - 100[(d)] and combinations | 0.5–2.0 | Curatives |
| MNA[(e)], NDPA[(f)] | Combinations | 0.2–1.0 | Stabilizers |

[(a)]isophorone diisocyanate (difunctional)
[(b)]hexamethylene diisocyanate (difunctional)
[(c)]dimeryl diisocyanate (difunctional)
[(d)]Desmodur N100 (polyfunctional) (Available from Mobay Corp., Pittsburgh, PA)
[(e)]N-methyl-P-nitroaniline
[(f)]2-nitrodiphenylamine

DETAILED DESCRIPTION

The present invention features rocket motor propellant formulas demonstrating higher overall performance without losing any of the processability or safety aspects of the baseline or original propellants which the compositions of the invention modify. Thus, the hydroxy-terminated polyether bound propellants are generally easily manufactured by conventional processes and are relatively safe to use (generally classified as non-mass-detonable) in contrast to higher hazards double-based propellants which are classified as mass-detonable.

In conjunction with the descriptions contained herein, the example utilized is considered exemplary of the significance of the overall performance enhancement attributable to the invention. In this regard, the use of relatively larger amounts of $Bi_2O_3$, i.e., above 21%, should produce additional enhancement in the use of lesser amounts, somewhat less. It is further noteworthy that the burn rate and other important factors with respect to operation of the rocket motors appear little affected by the substitutions in accordance with the invention.

Table II depicts a baseline hydroxy-terminated polyether binder aluminum fueled rocket motor propellant that is typical of those improved by the invention and is utilized as a control or baseline propellant which can be used for performance comparison with the propellants of the invention. This formula contains 20% aluminum fuel, 10% ammonium nitrate and 51% AP.

Table III depicts an example of a propellant formulated in accordance with the present invention including 21% $Bi_2O_3$ which replaces all of the ammonium nitrate and a portion of the AP. Note that the impulse x density is increased from 5 16.98 to 18.60 b-sec/in$^3$, an increase of over 9.5%.

A further comparison is depicted in Table IV—93-lb Motor Performance. Note that the total thrust produced by the motor utilizing the propellant formula of Example I exceeds that of the control or baseline formulation by something in excess of 10.2% and the average pressure increase exceeds 14%. The increased density results in a 93.4-lb. grain versus a 76.3-lb. grain for the control propellant formula for an identical sized grain.

Figure 1:
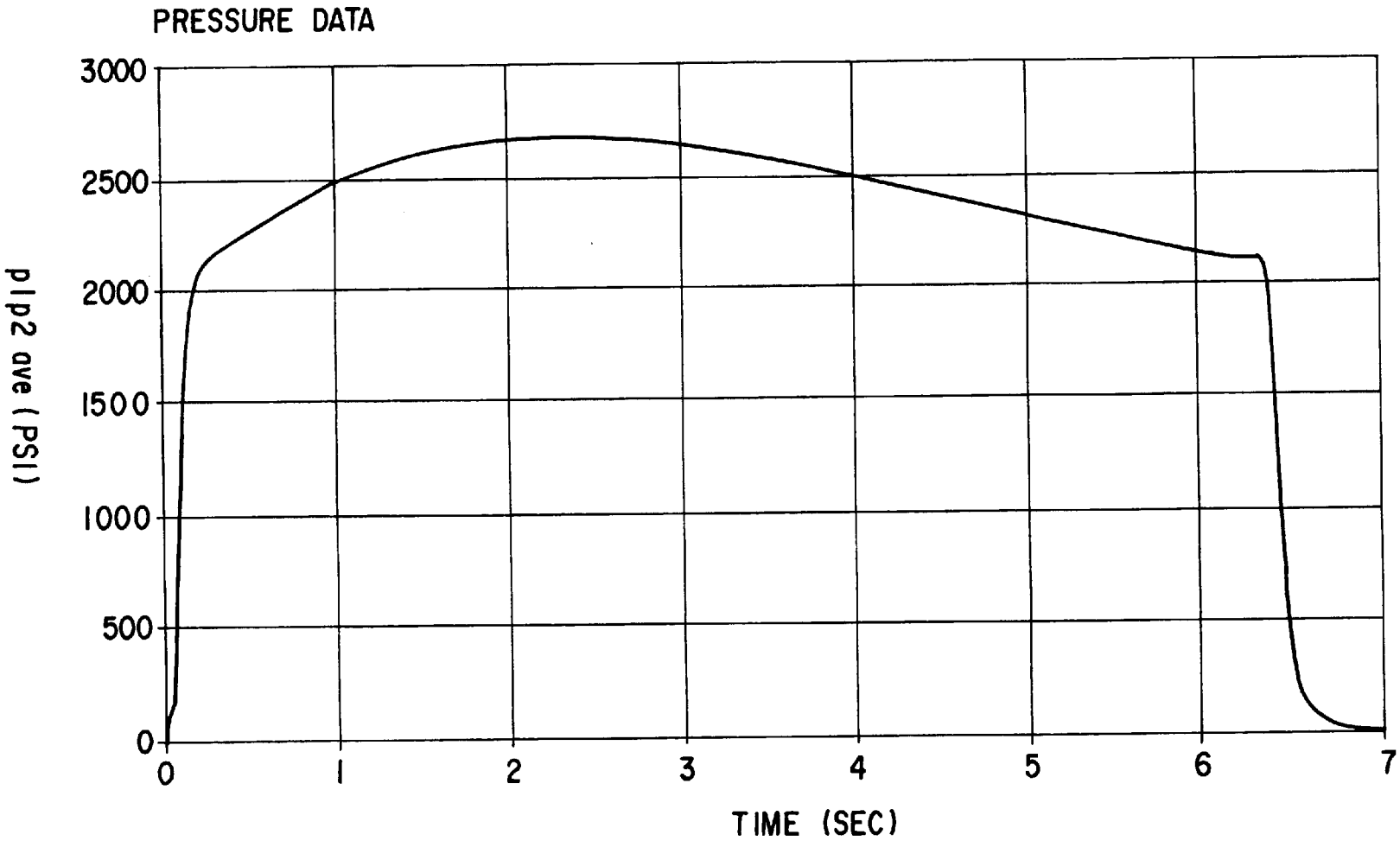
FIG. 1 shows a plot of measured pressure versus time for a rocket motor containing a propellant in accordance with the invention.
Figure 2:
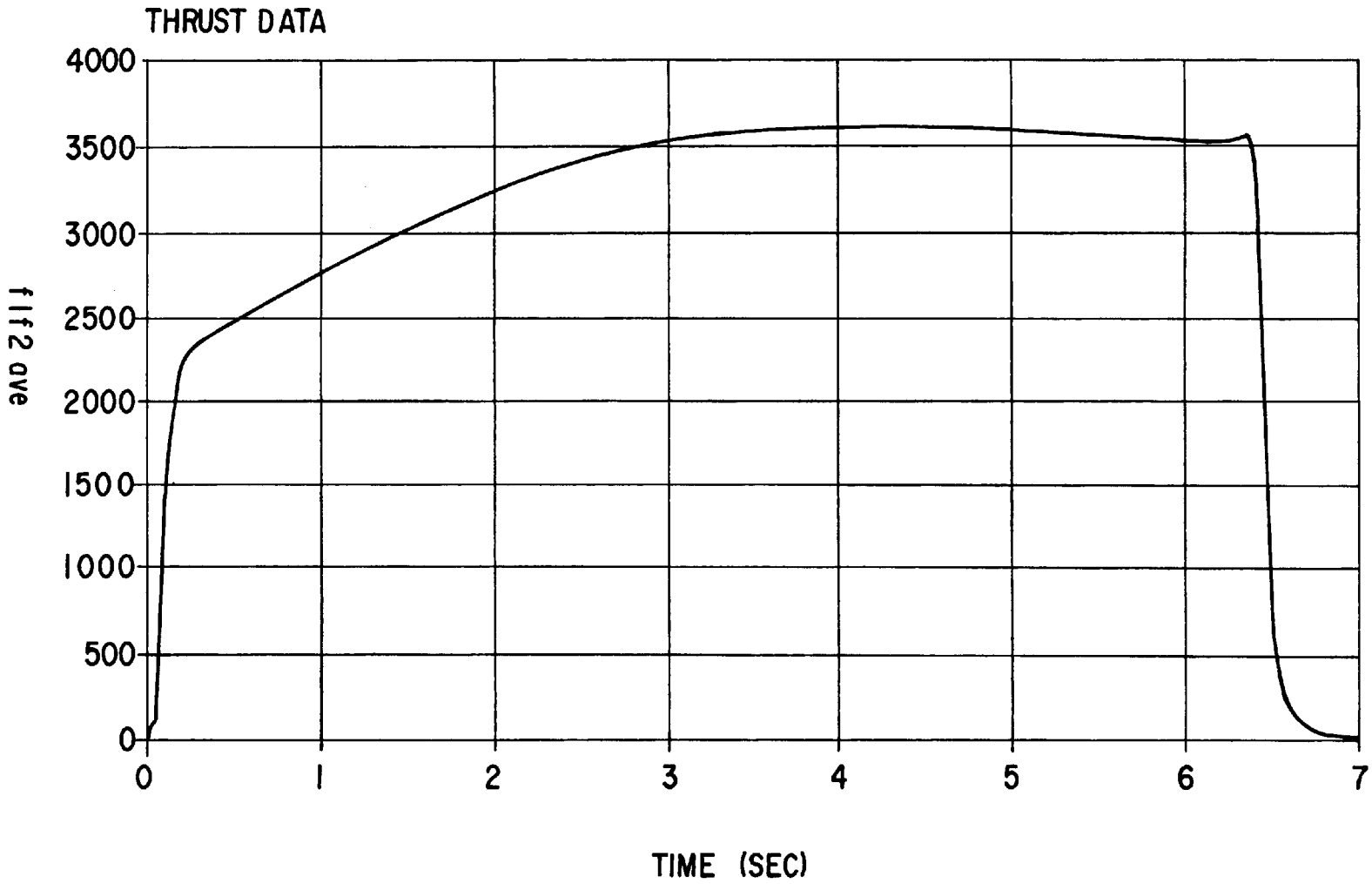
FIG. 2 depicts the average thrust for the firing of the propellant of the invention in accordance with FIG. 1.

FIGS. 1 and 2 depict average pressure and thrust data (in psi) for the firing of a double-length 40-lb. charge motor containing bismuth oxide and having dimensions identical to a motor containing the control propellant. The motor dimensions are listed in Table IV. The area under the thrust vs. time curve in FIGS. 2 is about 10% greater for the bismuth oxide-containing motor than for the control motor.

The propellants of the present invention can be prepared conventionally and in the same manner as the control propellant. With respect to that material, it is known that the composition can be mixed together generally in any particular order if the mixing is done within a reasonable length of time. Preferably, the propellants of the invention are prepared in conventional fashion by adding the following sequentially to a mixing vessel:

1. Binder components (added as liquids);
2. Plasticizers;
3. Solid fuel(s) (incremental addition);
4. Solid oxidizers (incremental addition); and
5. Cure catalyst(s) and curative(s) (isocyanate(s)).

Conventionally, the final mixing is done under vacuum, i.e., upon the addition of the solid fuel, which is typically a metal powder having an average size of approximately 30 microns.

TABLE II

CONTROL PROPELLANT

| INGREDIENT | FUNCTION | PERCENT |
|---|---|---|
| TPEG | Polyether Binder | 6.6 |
| BuNENA | Plasticizer | 10.4 |
| $Bi_2O_3$ | Oxidizer, Densifier | 0 |
| Ammonium Perchlorate | Oxidizer | 51.0 |
| Ammonium Nitrate | Oxidizer | 10.0 |
| Aluminum | Fuel | 20.0 |
| Isocyanates | Curatives | 1.3 |
| MNA, NDPA | Stabilizers | 0.7 |
| Impuse X Density, b-sec/in$^3$ | Performance | 16.98 |

TABLE III

EXAMPLE I

| INGREDIENT | FUNCTION | PERCENT |
|---|---|---|
| TPEG | Polyether Binder | 5.5 |
| BuNENA | Plasticizer | 8.2 |
| $Bi_2O_3$ | Oxidizer, Densifier | 21.0 |
| Ammonium Perchlorate | Oxidizer | 44.0 |
| Ammonium Nitrate | Oxidizer | 0 |
| Aluminum | Fuel | 20.0 |
| Isocyanates | Curatives | .8 |
| MNA, NDPA | Stabilizers | 0.5 |
| Impulse X Density, b-sec/in$^3$ | Performance | 18.60 |

TABLE IV

93-LB MOTOR PERFORMANCE

| MOTOR | CONTROL (TABLE II) HTPE | $Bi_2O_3$ (TABLE III) EXAMPLE I |
|---|---|---|
| GRAIN LENGTH, IN | 23 | 23 |
| GRAIN OD, IN | 8.385 | 8.385 |
| GRAIN ID, IN | 2.25 | 2.25 |
| WEIGHT, LBS | 76.3 | 93.4 |
| AVG PRESSURE, PSI | 2128 | 2427 |
| TOTAL THRUST LBF-SEC | 19,041 | 20,998 |

The mixing temperatures are typically 25–60° C. but, of course, will vary depending on the exact composition of a formula.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A solid propellant composition comprising a plasticizer, a binder, a fuel, an oxidizer wherein the oxidizer comprises, based on the weight of the total propellant composition:

(a) 10–40 percent bismuth oxide ($Bi_2O_3$);

(b) 25–60 percent ammonium perchlorate (AP) ($NH_4ClO_4$).

2. The solid propellant of claim 1 wherein the oxidizer comprises:

(a) 20–22 percent bismuth oxide ($Bi_2O_3$);

(b) 43–45 percent ammonium perchlorate (AP) ($NH_4ClO_4$).

3. The solid propellant composition of claim 1 wherein the binder includes an amount of hydroxy-terminated polyether.

4. The solid propellant of claim 3 wherein said hydroxy-terminated polyether has a number average molecular weight of 1000 to 9000.

5. The solid propellant composition of claim 1 wherein said plasticizer is selected from the group consisting of n-butyl-2-nitratoethyl nitramine (BuNENA), trimethloethane, trinitrate (TMETN), triethyleneglycol dinitrate (TEGDN), butanetriol trinitrate (BTTN), and mixtures thereof.

6. The solid propellant of claim 5 wherein said hydroxy-terminated polyether has a number average molecular weight of 1000 to 9000.

7. The solid propellant composition of claim 6 wherein said binder includes TPEG and said plasticizer includes BuNENA.

8. The solid propellant composition of claim 1 wherein the oxidizer is free of ammonium nitrate ($NH_4NO_3$).

9. The solid propellant composition of claim 1 including at least 20% $Bi_2O_3$.

10. The solid propellant composition of claim 9 wherein the oxidizer is free of ammonium nitrate ($NH_4NO_3$).

11. The solid propellant composition of claim 9 wherein said binder includes TPEG and said plasticizer includes BuNENA.

12. A solid propellant composition for rocket motors comprising:

(a) 10–40% bismuth oxide ($Bi_2O_3$);

(b) 25–60% ammonium chloride ($NH_4ClO_4$);

(c) 0–10% ammonium nitrate ($NH_4NO_3$);

(d) 15–25% fuel selected from the group consisting of aluminum, zirconium, magnesium and mixtures thereof;

(e) 3–12% binder selected from the group consisting of hydroxyl-terminated polyethers having a number average molecular weight of about 1000 to 9000;

(f) 5–15% plasticizer selected from the group consisting of n-butyl-2-nitratoethyl nitramine (BuNENA), trimethloethane, trinitrate (TMETN), triethyleneglycol dinitrate (TEGDN), butanetriol trinitrate (BTTN), and mixtures thereof;

(g) 0.5–2.0% curatives selected from the group consisting of isophorone diisocyanate (IPDI), hexamethylene diisocyanate (HDI), dimeryl diisocyanate (DDI), desmodur N100 and mixtures thereof; and (h) 0.2–1.0% stabilizers selected from the group consisting of N-methyl-p-nitroaniline, 2-nitrodiphenylamine and mixtures thereof.

13. The solid propellant composition of claim 12 including at least 20% $Bi_2O_3$.

14. The solid propellant of claim 12 wherein said binder includes TPEG, said plasticizer includes BuNENA and said fuel contains Al.

15. The solid propellant of claim 14 wherein the formula is free of $NH_4NO_3$.

16. The solid propellant of claim 15 including at least 20% $Bi_2O_3$ and <50% $NH_4ClO_4$.

* * * * *